US008657571B2

(12) United States Patent
Hofer et al.

(10) Patent No.: US 8,657,571 B2
(45) Date of Patent: Feb. 25, 2014

(54) SUPERSONIC COMPRESSOR ROTOR AND METHODS FOR ASSEMBLING SAME

(75) Inventors: Douglas Carl Hofer, Clifton Park, NY (US); Zachary William Nagel, Ballston Lake, NY (US); Dhananjayarao Gottapu, Bangalore (IN)

(73) Assignee: General Electric Company, Niskayuna, NY (US)

( * ) Notice: Subject to any disclaimer, the term of this patent is extended or adjusted under 35 U.S.C. 154(b) by 538 days.

(21) Appl. No.: 12/974,566

(22) Filed: Dec. 21, 2010

(65) Prior Publication Data

US 2012/0156016 A1 Jun. 21, 2012

(51) Int. Cl.
*F04D 21/00* (2006.01)

(52) U.S. Cl.
USPC ..... 415/181; 415/1

(58) Field of Classification Search
USPC ..... 415/181, 1
See application file for complete search history.

(56) References Cited

U.S. PATENT DOCUMENTS

| | | | |
|---|---|---|---|
| 2,925,952 | A | 2/1960 | Garve |
| 4,012,166 | A | 3/1977 | Kaesser et al. |
| 4,199,296 | A | 4/1980 | de Chair |
| 4,463,772 | A | 8/1984 | Ball |
| 4,620,679 | A | 11/1986 | Karanian |
| 4,704,861 | A | 11/1987 | Mowill |
| 5,525,038 | A | 6/1996 | Sharma et al. |
| 5,881,758 | A | 3/1999 | Koncsek et al. |
| 6,358,003 | B2 | 3/2002 | Schlechtriem |
| 6,428,271 | B1 | 8/2002 | Ress, Jr. et al. |
| 6,488,469 | B1 | 12/2002 | Yousser et al. |
| 7,070,388 | B2 | 7/2006 | Meng et al. |

(Continued)

FOREIGN PATENT DOCUMENTS

| | | |
|---|---|---|
| EP | 1126133 A2 | 8/2001 |
| GB | 885661 | 12/1961 |
| WO | 2009025803 A1 | 2/2009 |

OTHER PUBLICATIONS

Shawn P. Lawlor and Peter Baldwin, Conceptual Design of a Supersonic CO2 Compressor, Proceedings of ASME 2005, ASME Turbo Expo 2005, Jun. 6-9, 2005, 8 pages, Ramgen Power Systems, Bellevue, WA.

(Continued)

*Primary Examiner* — Edward Look
*Assistant Examiner* — Jason Davis
(74) *Attorney, Agent, or Firm* — Andrew J. Caruso

(57) ABSTRACT

A supersonic compressor rotor that includes a rotor disk that includes a body that extends between a radially inner surface and a radially outer surface. A plurality of vanes are coupled to the body. The vanes extend outwardly from the rotor disk. Adjacent vanes form a pair and are oriented such that a flow channel is defined between each pair of adjacent vanes. The flow channel extends between an inlet opening and an outlet opening. At least one supersonic compression ramp is positioned within the flow channel. The supersonic compression ramp is configured to condition a fluid being channeled through the flow channel such that the fluid includes a first velocity at the inlet opening and a second velocity at the outlet opening. Each of the first velocity and the second velocity being supersonic with respect to said rotor disk surfaces.

13 Claims, 7 Drawing Sheets

(56) References Cited

U.S. PATENT DOCUMENTS

| | | | | |
|---|---|---|---|---|
| 7,293,955 | B2 | 11/2007 | Lawlor et al. | |
| 7,296,396 | B1 | 11/2007 | Wilson et al. | |
| 7,334,990 | B2 | 2/2008 | Lawlor et al. | |
| 7,337,606 | B2 | 3/2008 | Brouillette et al. | |
| 7,434,400 | B2 | 10/2008 | Lawlor et al. | |
| 2009/0107557 | A1 | 4/2009 | Conners | |
| 2009/0196731 | A1 | 8/2009 | Lawlor | |
| 2010/0005763 | A1 | 1/2010 | Bloom | |
| 2010/0043389 | A1 | 2/2010 | Conners | |
| 2012/0107106 | A1* | 5/2012 | Hofer et al. | 415/181 |
| 2012/0156015 | A1* | 6/2012 | Devi et al. | 415/181 |

OTHER PUBLICATIONS

H.J. Lichtfuss, H. Starken, Supersonic Cascade Flow, Progress in Aerospace Sciences vol. 15, 1974, pp. 37-149.

M. F. El-Dosoky, A. Rona and J. P. Gostelow, An Analytical Model for Over-Shroud Leakage Losses in a Shrouded Turbine Stage, ASME Turbo Expo 2007, Power for Land, Sea and Air, GT2007, May 2007, pp. 1-10, Montreal Canada.

Allan D. Grosvenor, David A. Taylor, Jonathan R. Bucher, Michael J. Aarnio, Paul M. Brown, Robert D. Draper, Shawn P. Lawlor, Measured and Predicted Performance of a High Pressure Ratio Supersonic Compressor Rotor, ASME Turbo Expo 2008, Power for Land, Sea and Air, GT2008, Jun. 2008, pp. 1-12, Berlin, Germany.

* cited by examiner

SUPERSONIC COMPRESSOR ROTOR AND METHODS FOR ASSEMBLING SAME

BACKGROUND OF THE INVENTION

The subject matter described herein relates generally to supersonic compressor systems and, more particularly, to a supersonic compressor rotor for use with a supersonic compressor system.

At least some known supersonic compressor systems include a drive assembly, a drive shaft, and at least one supersonic compressor rotor for compressing a fluid. The drive assembly is coupled to the supersonic compressor rotor with the drive shaft to rotate the drive shaft and the supersonic compressor rotor.

Known supersonic compressor rotors include a plurality of strakes coupled to a rotor disk. Each strake is oriented circumferentially about the rotor disk and define an axial flow channel between adjacent strakes. At least some known supersonic compressor rotors include a supersonic compression ramp that is coupled to the rotor disk. Known supersonic compression ramps are positioned within the axial flow path and are configured to form a compression wave within the flow path.

During operation of known supersonic compressor systems, the drive assembly rotates the supersonic compressor rotor at a high rotational speed. A fluid is channeled to the supersonic compressor rotor such that the fluid is characterized by a velocity that is supersonic with respect to the supersonic compressor rotor at the flow channel. In known supersonic compressor rotors, as fluid is channeled through the axial flow channel, the supersonic compression ramp causes a formation of a normal shockwave within the flow channel. As fluid passes through the normal shockwave, a velocity of the fluid is reduced to subsonic with respect to the supersonic compressor rotor. As a velocity of fluid is reduced through the normal shockwave, an energy of fluid is also reduced. The reduction in fluid energy through the flow channel may reduce an operating efficient of known supersonic compressor systems. Known supersonic compressor systems are described in, for example, U.S. Pat. Nos. 7,334,990 and 7,293,955 filed Mar. 28, 2005 and Mar. 23, 2005 respectively, and United States Patent Application 2009/0196731 filed Jan. 16, 2009.

BRIEF DESCRIPTION OF THE INVENTION

In one aspect, a supersonic compressor rotor is provided. The supersonic compressor rotor includes a rotor disk that includes a body that extends between a radially inner surface and a radially outer surface. A plurality of vanes are coupled to the body. The vanes extend outwardly from the rotor disk. Adjacent vanes form a pair and are oriented such that a flow channel is defined between each pair of adjacent vanes. The flow channel extends between an inlet opening and an outlet opening. At least one supersonic compression ramp is positioned within the flow channel. The supersonic compression ramp is configured to condition a fluid being channeled through the flow channel such that the fluid includes a first velocity at the inlet opening and a second velocity at the outlet opening. Each of the first velocity and the second velocity being supersonic with respect to said rotor disk surfaces.

In another aspect, a supersonic compressor system is provided. The supersonic compressor system includes a housing that includes an inner surface that defines a cavity extending between a fluid inlet and a fluid outlet. A drive shaft is positioned within the housing. The drive shaft is rotatably coupled to a driving assembly. A supersonic compressor rotor is coupled to the drive shaft. The supersonic compressor rotor is positioned between the fluid inlet and the fluid outlet for channeling fluid from the fluid inlet to the fluid outlet. The supersonic compressor includes a rotor disk that includes a body that extends between a radially inner surface and a radially outer surface. A plurality of vanes are coupled to the body. The vanes extend outwardly from the rotor disk. Adjacent vanes form a pair and are oriented such that a flow channel is defined between each pair of adjacent vanes. The flow channel extends between an inlet opening and an outlet opening. At least one supersonic compression ramp is positioned within the flow channel. The supersonic compression ramp is configured to condition a fluid being channeled through the flow channel such that the fluid includes a first velocity at the inlet opening and a second velocity at the outlet opening. Each of the first velocity and the second velocity being supersonic with respect to the rotor disk surfaces.

In yet another aspect, a method of assembling a supersonic compressor rotor is provided. The method includes providing a rotor disk that includes a body that extends between a radially inner surface and a radially outer surface. A plurality of vanes are coupled to the body. Adjacent vanes form a pair and are oriented such that a flow channel is defined between each pair of adjacent vanes. The flow channel extends between an inlet opening and an outlet opening. At least one supersonic compression ramp is coupled to one of a vane of the plurality of vanes and the rotor disk. The supersonic compression ramp is positioned within the flow channel and is configured to condition a fluid being channeled through the flow channel such that the fluid includes a first velocity at the inlet opening and a second velocity at the outlet opening. Each of the first velocity and the second velocity being supersonic with respect to the rotor disk surfaces.

BRIEF DESCRIPTION OF THE DRAWING

These and other features, aspects, and advantages of the present invention will become better understood when the following detailed description is read with reference to the accompanying drawings in which like characters represent like parts throughout the drawings, wherein.

Figure 1:
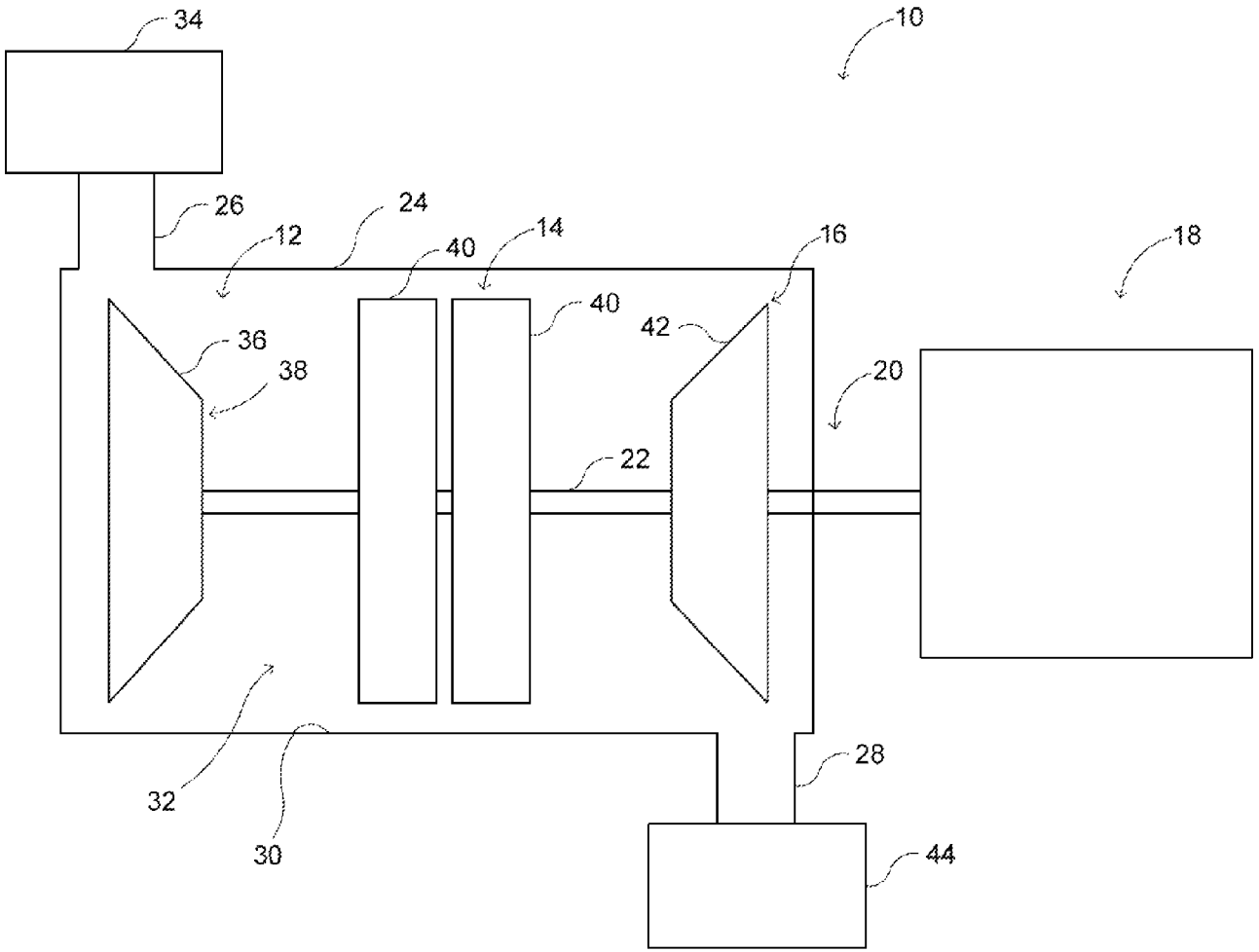
FIG. 1 is a schematic view of an exemplary supersonic compressor.

Unless otherwise indicated, the drawings provided herein are meant to illustrate key inventive features of the invention. These key inventive features are believed to be applicable in a wide variety of systems comprising one or more embodiments of the invention. As such, the drawings are not meant to include all conventional features known by those of ordinary skill in the art to be required for the practice of the invention.

DETAILED DESCRIPTION OF THE INVENTION

In the following specification and the claims, which follow, reference will be made to a number of terms, which shall be defined to have the following meanings.

The singular forms "a", "an", and "the" include plural referents unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about" and "substantially", are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

As used herein, the term "upstream" refers to a forward or inlet end of a supersonic compressor system, and the term "downstream" refers to an aft or outlet end of the supersonic compressor system.

As used herein, the term "supersonic compressor rotor" refers to a compressor rotor comprising a supersonic compression ramp disposed within a fluid flow channel of the supersonic compressor rotor. Supersonic compressor rotors are said to be "supersonic" because they are designed to rotate about an axis of rotation at high speeds such that a moving fluid, for example a moving gas, encountering the rotating supersonic compressor rotor at a supersonic compression ramp disposed within a flow channel of the rotor, is said to have a relative fluid velocity which is supersonic. The relative fluid velocity can be defined in terms of the vector sum of the rotor velocity at the supersonic compression ramp and the fluid velocity just prior to encountering the supersonic compression ramp. This relative fluid velocity is at times referred to as the "local supersonic inlet velocity", which in certain embodiments is a combination of an inlet gas velocity and a tangential speed of a supersonic compression ramp disposed within a flow channel of the supersonic compressor rotor. The supersonic compressor rotors are engineered for service at very high tangential speeds, for example tangential speeds in a range of 300 meters/second to 800 meters/second.

The exemplary systems and methods described herein overcome disadvantages of known supersonic compressor assemblies by providing a supersonic compressor rotor that facilitates channeling a fluid through a flow path wherein the fluid is characterized by a velocity that is supersonic at an outlet of the fluid channel. More specifically, the embodiments described herein include a supersonic compression ramp that is positioned within the flow channel and that is configured to prevent a formation of a normal shockwave within the flow channel. By preventing the formation of the normal shockwave within the flow channel, the fluid entropy rise is reduced.

FIG. 1 is a schematic view of an exemplary supersonic compressor system 10. In the exemplary embodiment, supersonic compressor system 10 includes an intake section 12, a compressor section 14 coupled downstream from intake section 12, a discharge section 16 coupled downstream from compressor section 14, and a drive assembly 18. Compressor section 14 is coupled to drive assembly 18 by a rotor assembly 20 that includes a drive shaft 22. In the exemplary embodiment, each of intake section 12, compressor section 14, and discharge section 16 are positioned within a compressor housing 24. More specifically, compressor housing 24 includes a fluid inlet 26, a fluid outlet 28, and an inner surface 30 that defines a cavity 32. Cavity 32 extends between fluid inlet 26 and fluid outlet 28 and is configured to channel a fluid from fluid inlet 26 to fluid outlet 28. Each of intake section 12, compressor section 14, and discharge section 16 are positioned within cavity 32. Alternatively, intake section 12 and/or discharge section 16 may not be positioned within compressor housing 24.

In the exemplary embodiment, fluid inlet 26 is configured to channel a flow of fluid from a fluid source 34 to intake section 12. The fluid may be any fluid such as, for example a gas, a gas mixture, and/or a particle-laden gas. Intake section 12 is coupled in flow communication with compressor section 14 for channeling fluid from fluid inlet 26 to compressor section 14. Intake section 12 is configured to condition a fluid flow having one or more predetermined parameters, such as a velocity, a mass flow rate, a pressure, a temperature, and/or any suitable flow parameter. In the exemplary embodiment, intake section 12 includes an inlet guide vane assembly 36 that is coupled between fluid inlet 26 and compressor section 14 for channeling fluid from fluid inlet 26 to compressor section 14. Inlet guide vane assembly 36 includes one or more inlet guide vanes 38 that are coupled to compressor housing 24.

Compressor section 14 is coupled between intake section 12 and discharge section 16 for channeling at least a portion of fluid from intake section 12 to discharge section 16. Compressor section 14 includes at least one supersonic compressor rotor 40 that is rotatably coupled to drive shaft 22. Supersonic compressor rotor 40 is configured to increase a pressure of fluid, reduce a volume of fluid, and/or increase a temperature of fluid being channeled to discharge section 16. Discharge section 16 includes an outlet guide vane assembly 42 that is coupled between supersonic compressor rotor 40 and fluid outlet 28 for channeling fluid from supersonic compressor rotor 40 to fluid outlet 28. Fluid outlet 28 is configured to channel fluid from outlet guide vane assembly 42 and/or supersonic compressor rotor 40 to an output system 44 such as, for example, a turbine engine system, a fluid treatment system, and/or a fluid storage system. Drive assembly 18 is configured to rotate drive shaft 22 to cause a rotation of supersonic compressor rotor 40 and/or outlet guide vane assembly 42.

During operation, intake section 12 channels fluid from fluid source 34 towards compressor section 14. Compressor section 14 compresses the fluid and discharges the compressed fluid towards discharge section 16. Discharge section 16 channels the compressed fluid from compressor section 14 to output system 44 through fluid outlet 28.

Figure 2:
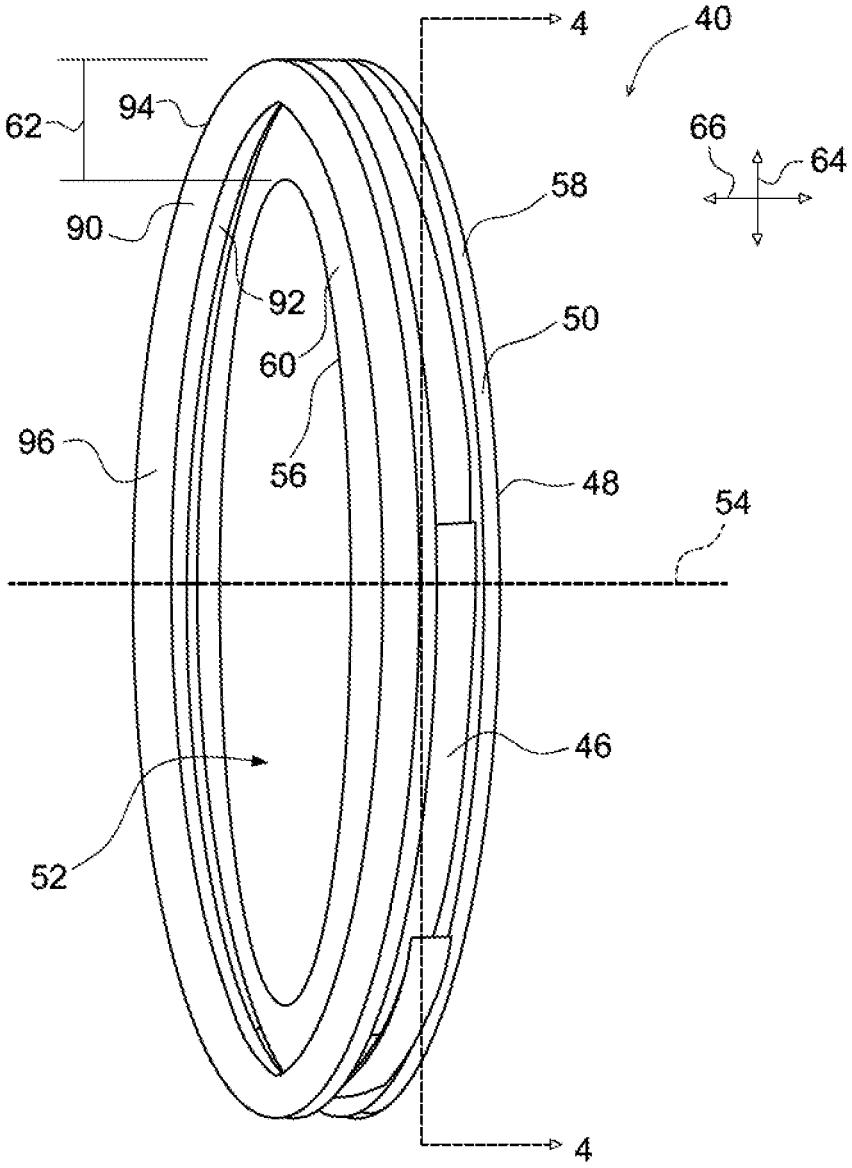
FIG. 2 is a perspective view of an exemplary supersonic compressor rotor that may be used with the supersonic compressor shown in FIG. 1.
Figure 3:
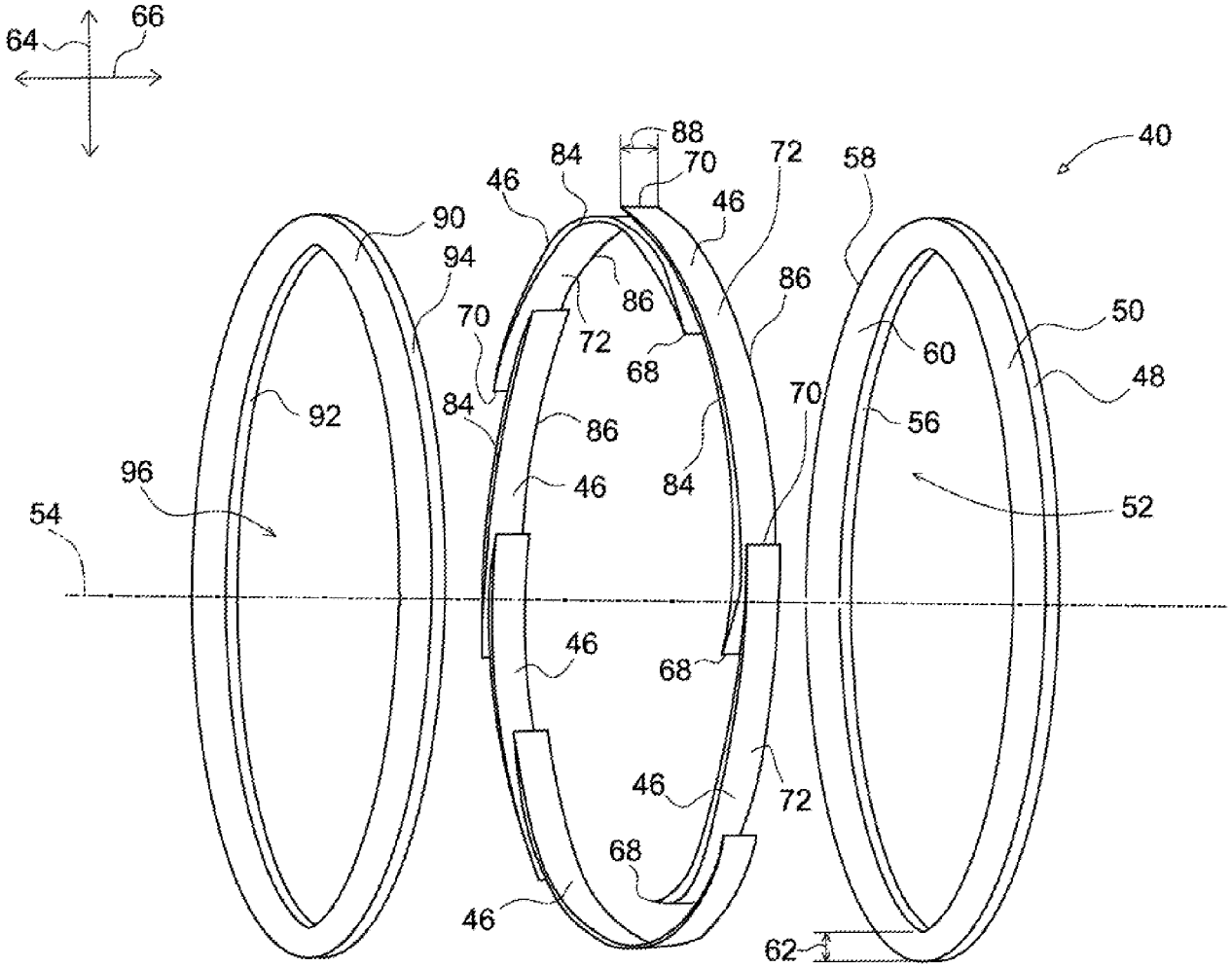
FIG. 3 is an exploded perspective view of the supersonic compressor rotor shown in FIG. 2.
Figure 4:
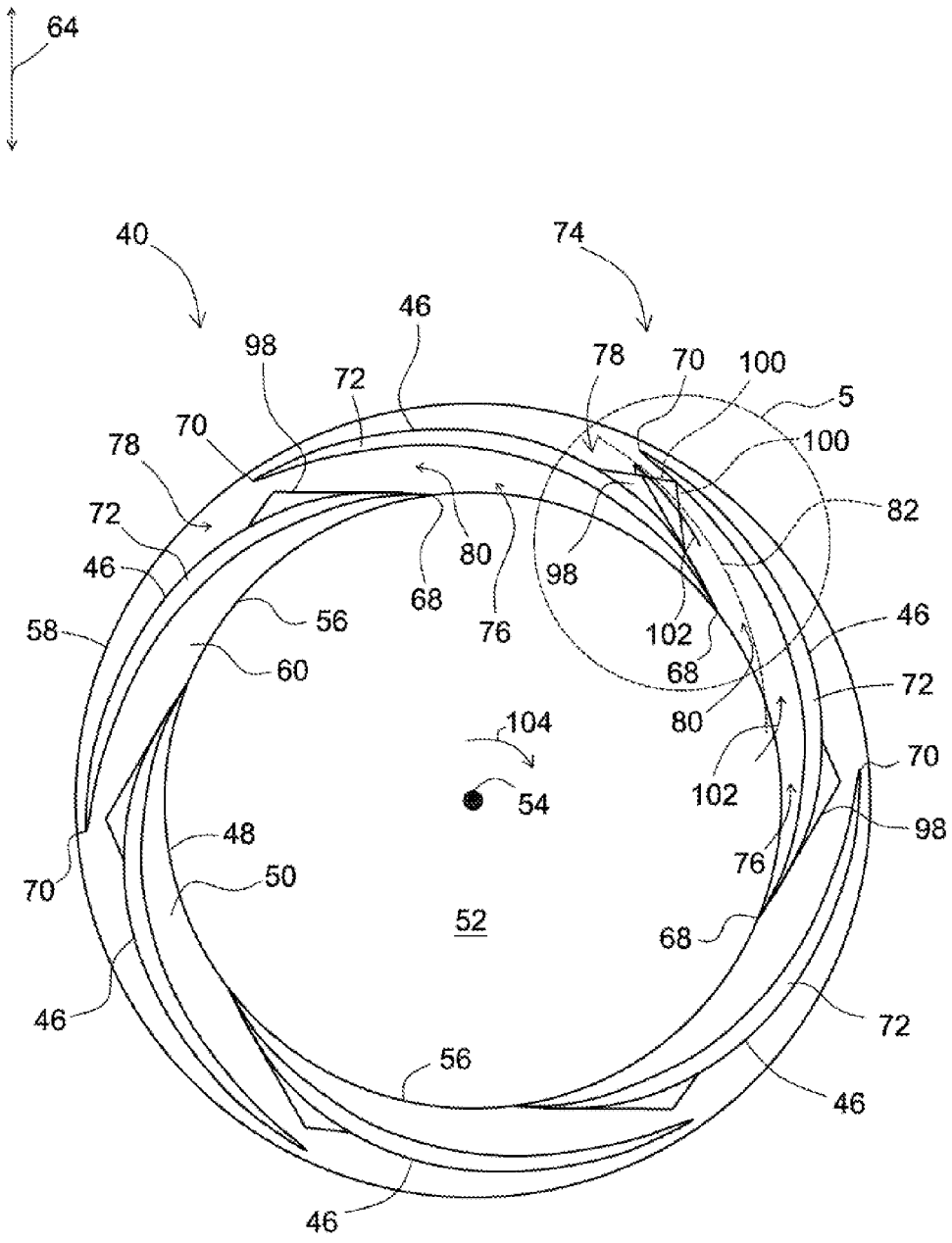
FIG. 4 is a cross-sectional view of the supersonic compressor rotor shown in FIG. 2 along sectional line 4-4.

FIG. 2 is a perspective view of an exemplary supersonic compressor rotor 40. FIG. 3 is an exploded perspective view of supersonic compressor rotor 40. FIG. 4 is a cross-sectional view of supersonic compressor rotor 40 at sectional line 4-4 shown in FIG. 2. Identical components shown in FIG. 3 and FIG. 4 are labeled with the same reference numbers used in FIG. 2. In the exemplary embodiment, supersonic compressor rotor 40 includes a plurality of vanes 46 that are coupled to a rotor disk 48. Rotor disk 48 includes an annular disk body 50 that defines an inner cylindrical cavity 52 extending generally axially through disk body 50 along a centerline axis 54. Disk body 50 includes a radially inner surface 56, a radially outer surface 58, and an endwall 60. Radially inner surface 56 defines inner cylindrical cavity 52. Inner cylindrical cavity 52 has a substantially cylindrical shape and is oriented about centerline axis 54. Inner cylindrical cavity 52 is sized to receive drive shaft 22 (shown in FIG. 1) therethrough. Endwall 60 extends radially outwardly from inner cylindrical cavity 52 and between radially inner surface 56 and radially outer surface 58. Endwall 60 includes a width 62 defined in a radial direction 64 that is oriented perpendicular to centerline axis 54.

In the exemplary embodiment, each vane 46 is coupled to endwall 60 and extends outwardly from endwall 60 in an axial direction 66 that is generally parallel to centerline axis 54. Each vane 46 includes an inlet edge 68, an outlet edge 70, and extends between inlet edge 68 and outlet edge 70. Inlet edge 68 is positioned adjacent radially inner surface 56. Outlet edge 70 is positioned adjacent radially outer surface 58. In the exemplary embodiment, adjacent vanes 46 form a pair 74 of vanes 46. Each pair 74 is oriented to define an inlet opening 76, an outlet opening 78, and a flow channel 80 between adjacent vanes 46. Flow channel 80 extends between inlet opening 76 and outlet opening 78 and defines a flow path, represented by arrow 82, (shown in FIG. 4) from inlet opening 76 to outlet opening 78. Flow path 82 is oriented generally parallel to vane 46. Flow channel 80 is sized, shaped, and oriented to channel fluid along flow path 82 from inlet opening 76 to outlet opening 78 in radial direction 64. Inlet opening 76 is defined between adjacent inlet edges 68 of adjacent vanes 46. Outlet opening 78 is defined between adjacent outlet edges 70 of adjacent vanes 46. Vane 46 extends radially between inlet edge 68 and outlet edge 70 and extends between radially inner surface 56 and radially outer surface 58. Vane 46 includes an outer surface 84 and an opposite inner surface 86. Vane 46 extends between outer surface 84 and inner surface 86 to define an axial height 88 of flow channel 80.

Referring to FIG. 2 and FIG. 3, in the exemplary embodiment, a shroud assembly 90 is coupled to outer surface 84 of each vane 46 such that flow channel 80 (shown in FIG. 4) is defined between shroud assembly 90 and endwall 60. Shroud assembly 90 includes an inner edge 92 and an outer edge 94. Inner edge 92 defines a substantially cylindrical opening 96. Shroud assembly 90 is oriented coaxially with rotor disk 48, such that inner cylindrical cavity 52 is concentric with opening 96. Shroud assembly 90 is coupled to each vane 46 such that inlet edge 68 of vane 46 is positioned adjacent inner edge 92 of shroud assembly 90, and outlet edge 70 of vane 46 is positioned adjacent outer edge 94 of shroud assembly 90. Alternatively, supersonic compressor rotor 40 does not include shroud assembly 90.

In such an embodiment, a diaphragm assembly (not shown) is positioned adjacent each outer surface 84 of vanes 46 such that the diaphragm assembly at least partially defines flow channel 80.

Referring to FIG. 4, in the exemplary embodiment, at least one supersonic compression ramp 98 is positioned within flow channel 80. Supersonic compression ramp 98 is positioned between inlet opening 76 and outlet opening 78, and is sized, shaped, and oriented to enable one or more compression waves 100 to form within flow channel 80.

During operation of supersonic compressor rotor 40, intake section 12 (shown in FIG. 1) channels a fluid 102 towards inlet opening 76 of flow channel 80. Fluid 102 has a first velocity, i.e. an approach velocity, just prior to entering inlet opening 76. Supersonic compressor rotor 40 is rotated about centerline axis 54 at a second velocity, i.e. a rotational velocity, represented by arrow 104, such that fluid 102 entering flow channel 80 has a third velocity, i.e. an inlet velocity at inlet opening 76 that is supersonic relative to vanes 46. As fluid 102 is channeled through flow channel 80 at a supersonic velocity, supersonic compression ramp 98 causes compression waves 100 to form within flow channel 80 to facilitate compressing fluid 102, such that fluid 102 includes an increased pressure and temperature, and/or includes a reduced volume at outlet opening 78.

Figure 5:
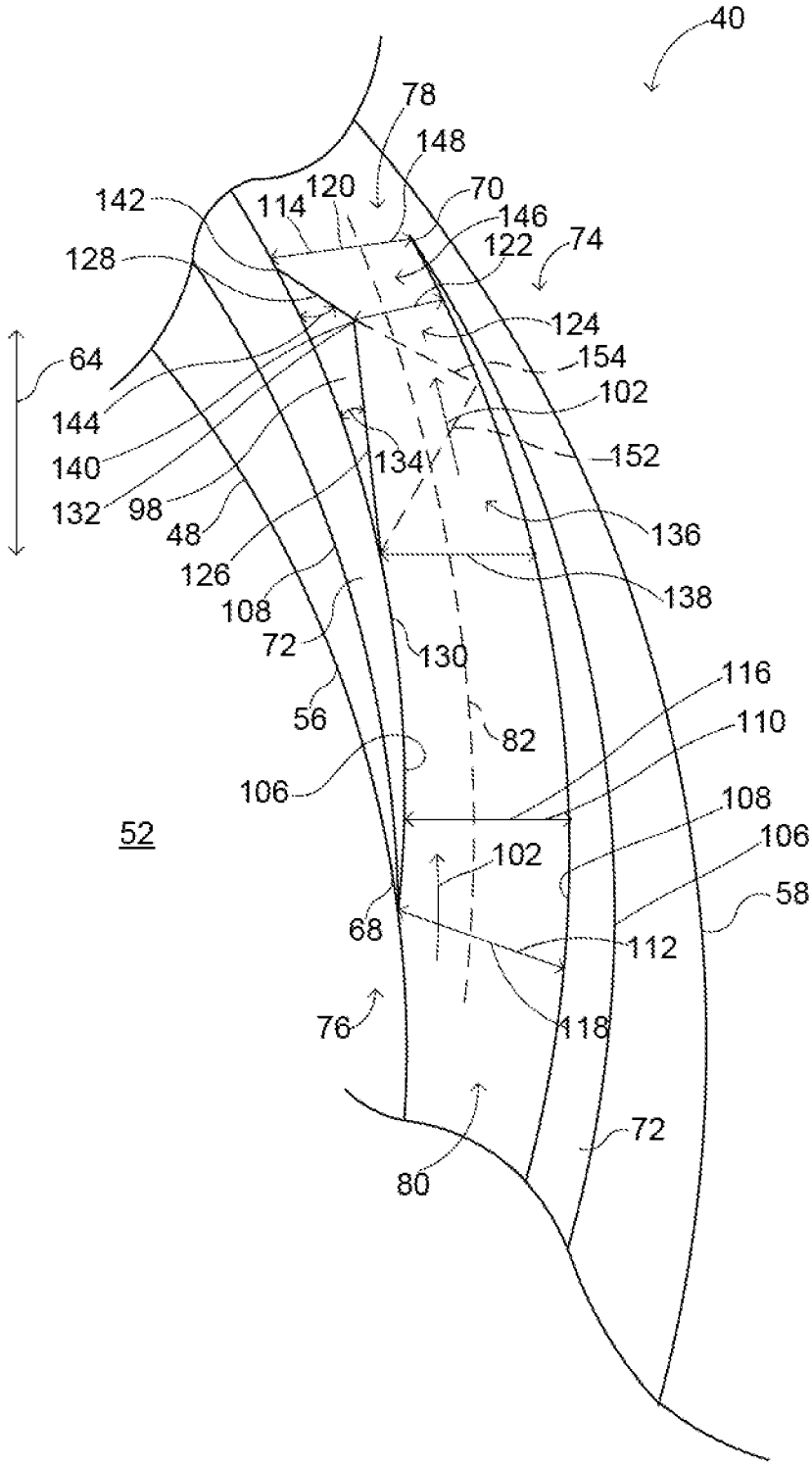
FIG. 5 is an enlarged cross-sectional view of a portion of the supersonic compressor rotor shown in FIG. 3 and taken along area 5.

FIG. 5 is an enlarged cross-sectional view of a portion of supersonic compressor rotor 40 taken along area 5 shown in FIG. 4. Identical components shown in FIG. 5 are labeled with the same reference numbers used in FIG. 2 and FIG. 4. In the exemplary embodiment, each vane 46 includes a first side, i.e. a pressure side 106 and an opposing second side, i.e. a suction side 108. Each pressure side 106 and suction side 108 extends between inlet edge 68 and outlet edge 70.

In the exemplary embodiment, each vane 46 is spaced circumferentially about inner cylindrical cavity 52 such that flow channel 80 is oriented generally radially between inlet opening 76 and outlet opening 78. Each inlet opening 76 extends between a pressure side 106 and an adjacent suction side 108 of vane 46 at inlet edge 68. Each outlet opening 78 extends between pressure side 106 and an adjacent suction side 108 at outlet edge 70, such that flow path 82 is defined radially outwardly from radially inner surface 56 to radially outer surface 58 in radial direction 64. Alternatively, adjacent vanes 46 may be oriented such that inlet opening 76 is defined at radially outer surface 58 and outlet opening 78 is defined at radially inner surface 56 such that flow path 82 is defined radially inwardly from radially outer surface 58 to radially inner surface 56. In the exemplary embodiment, flow channel 80 includes a circumferential width 110 that is defined between pressure side 106 and adjacent suction side 108 and is perpendicular to flow path 82. Inlet opening 76 has a first circumferential width 112 that is larger than a second circumferential width 114 of outlet opening 78. Alternatively, first circumferential width 112 of inlet opening 76 may be less than, or equal to, second circumferential width 114 of outlet opening 78. In the exemplary embodiment, each vane 46 is formed with an arcuate shape and is oriented such that flow channel 80 is defined with a spiral shape and generally converges inwardly between inlet opening 76 to outlet opening 78.

In the exemplary embodiment, flow channel 80 defines a cross-sectional area 116 that varies along flow path 82. Cross-sectional area 116 of flow channel 80 is defined perpendicularly to flow path 82 and is equal to circumferential width 110 of flow channel 80 multiplied by axial height 88 (shown in FIG. 3) of flow channel 80. Flow channel 80 includes a first area, i.e. an inlet cross-sectional area 118 at inlet opening 76, a second area, i.e. an outlet cross-sectional area 120 at outlet opening 78, and a third area, i.e. a minimum cross-sectional area 122 that is defined between inlet opening 76 and outlet opening 78. In the exemplary embodiment, minimum cross-sectional area 122 is less than inlet cross-sectional area 118 and outlet cross-sectional area 120. In one embodiment, minimum cross-sectional area 122 is equal to outlet cross-sectional area 120, wherein each of outlet cross-sectional area 120 and minimum cross-sectional area 122 is less than inlet cross-sectional area 118.

In the exemplary embodiment, supersonic compression ramp 98 is coupled to pressure side 106 of vane 46 and defines a throat region 124 of flow channel 80. Throat region 124 defines minimum cross-sectional area 122 of flow channel 80. In an alternative embodiment, supersonic compression ramp 98 may be coupled to suction side 108 of vane 46, endwall 60, and/or shroud assembly 90. In a further alternative embodiment, supersonic compressor rotor 40 includes a plurality of supersonic compression ramps 98 that are each coupled to pressure side 106, suction side 108, endwall 60, and/or shroud assembly 90. In such an embodiment, each supersonic compression ramp 98 collectively defines throat region 124.

In the exemplary embodiment, throat region 124 defines minimum cross-sectional area 122 that is less than inlet cross-sectional area 118 such that flow channel 80 has an area ratio defined as a ratio of inlet cross-sectional area 118 divided by minimum cross-sectional area 122 of between about 1.01 and 1.10. In one embodiment, the area ratio is between about 1.07 and 1.08. In an alternative embodiment, area ratio may be equal to or less than 1.01. In another alternative embodiment, area ratio may be equal to or greater than 1.10.

In the exemplary embodiment, supersonic compression ramp 98 includes a compression surface 126 and a diverging surface 128. Compression surface 126 includes a first edge, i.e. a leading edge 130 and a second edge, i.e. a trailing edge 132. Leading edge 130 is positioned closer to inlet opening 76 than trailing edge 132. Compression surface 126 extends between leading edge 130 and trailing edge 132 and is oriented at an oblique angle 134 from vane 46 towards adjacent suction side 108 and into flow path 82. Compression surface 126 converges towards an adjacent suction side 108 such that a compression region 136 is defined between leading edge 130 and trailing edge 132. Compression region 136 includes a cross-sectional area 138 of flow channel 80 that is reduced along flow path 82 from leading edge 130 to trailing edge 132. Trailing edge 132 of compression surface 126 defines throat region 124.

Diverging surface 128 is coupled to compression surface 126 and extends downstream from compression surface 126 towards outlet opening 78. Diverging surface 128 includes a first end 140 and a second end 142 that is closer to outlet opening 78 than first end 140. First end 140 of diverging surface 128 is coupled to trailing edge 132 of compression surface 126. Diverging surface 128 extends between first end 140 and second end 142 and is oriented at an oblique angle 144 from pressure side 106 towards trailing edge 132 of compression surface 126. Diverging surface 128 defines a diverging region 146 that includes a diverging cross-sectional area 148 that increases from trailing edge 132 of compression surface 126 to outlet opening 78. Diverging region 146 extends from throat region 124 to outlet opening 78. In an alternative embodiment, supersonic compression ramp 98 does not include diverging surface 128. In this alternative embodiment, trailing edge 132 of compression surface 126 is positioned adjacent outlet edge 70 of vane 46 such that throat region 124 is defined adjacent outlet opening 78.

During operation of supersonic compressor rotor 40, fluid 102 is channeled from inner cylindrical cavity 52 into inlet opening 76 at a first velocity, that is supersonic with respect to rotor disk 48. Fluid 102 entering flow channel 80 from inner cylindrical cavity 52 contacts leading edge 130 of supersonic compression ramp 98 to form a first oblique shockwave 152. Compression region 136 of supersonic compression ramp 98 is configured to cause first oblique shockwave 152 to be oriented at an oblique angle with respect to flow path 82 from leading edge 130 towards adjacent vane 46, and into flow channel 80. As first oblique shockwave 152 contacts adjacent vane 46, a second oblique shockwave 154 is reflected from adjacent vane 46 at an oblique angle with respect to flow path 82, and towards throat region 124 of supersonic compression ramp 98. In one embodiment, compression surface 126 is oriented to cause second oblique shockwave 154 to extend from first oblique shockwave 152 at adjacent vane 46 to trailing edge 132 that defines throat region 124. Supersonic compression ramp 98 is configured to cause each first oblique shockwave 152 and second oblique shockwave 154 to form within compression region 136.

As fluid 102 passes through compression region 136, a velocity of fluid 102 is reduced as fluid 102 passes through each first oblique shockwave 152 and second oblique shockwave 154. In addition, a pressure of fluid 102 is increased, and a volume of fluid 102 is decreased. In the exemplary embodiment, as fluid 102 passes through throat region 124, supersonic compression ramp 98 is configured to condition fluid 102 to have an outlet velocity at outlet opening 78 that is supersonic with respect to rotor disk 48. Supersonic compression ramp 98 is further configured to prevent a normal shockwave from being formed downstream of throat region 124 and within flow channel 80. A normal shockwave is a shockwave oriented perpendicular to flow path 82 that reduces a velocity of fluid 102 to a subsonic velocity with respect to rotor disk 48 as fluid passes through the normal shockwave. In the exemplary embodiment, throat region 124 is positioned sufficiently close to outlet opening 78 to prevent the normal shockwave from being formed within flow channel 80. In one embodiment, throat region 124 is positioned adjacent to outlet opening 78 to prevent the normal shockwave from being formed within flow channel 80.

Figure 6:
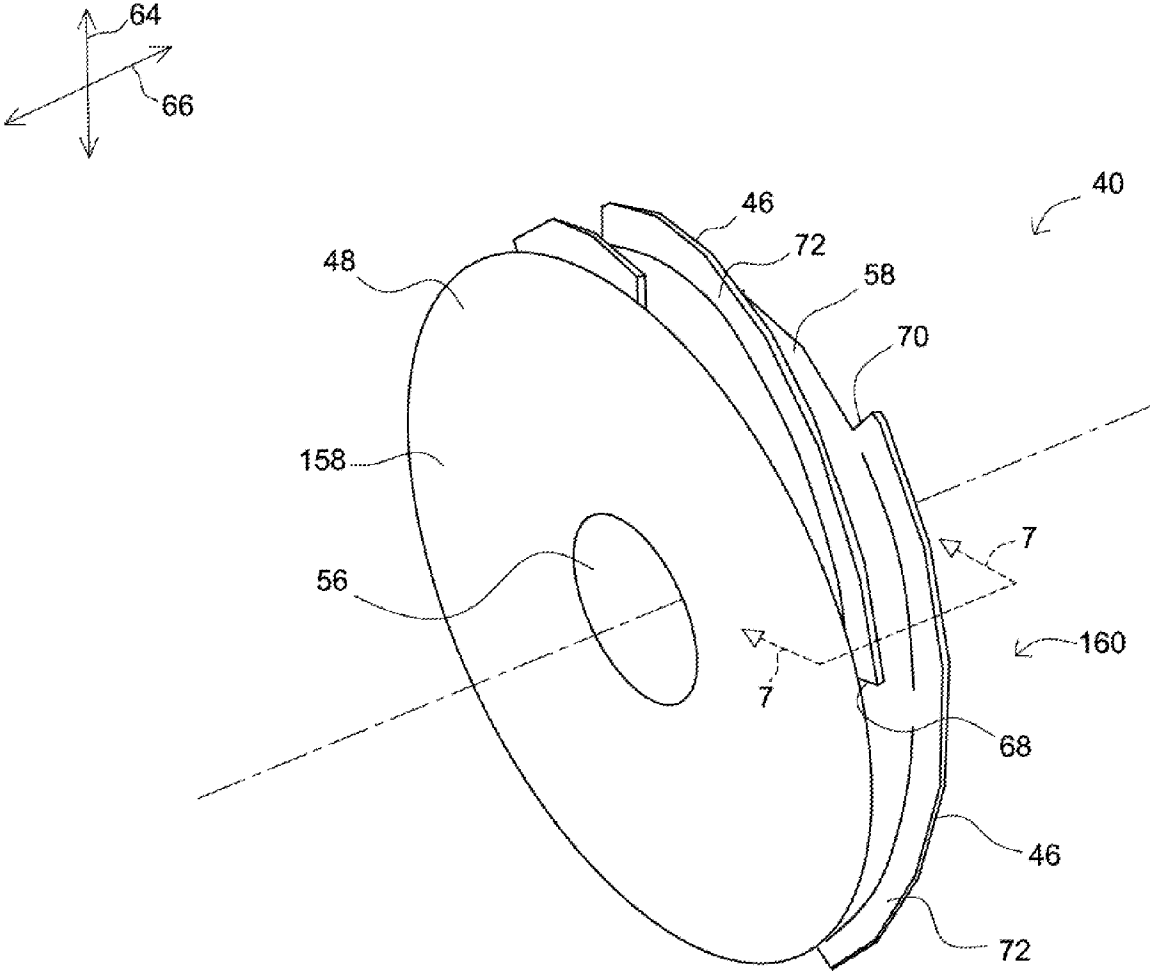
FIG. 6 is a perspective view of an alternative supersonic compressor rotor that may be used with the supersonic compressor shown in FIG. 1.
Figure 7:
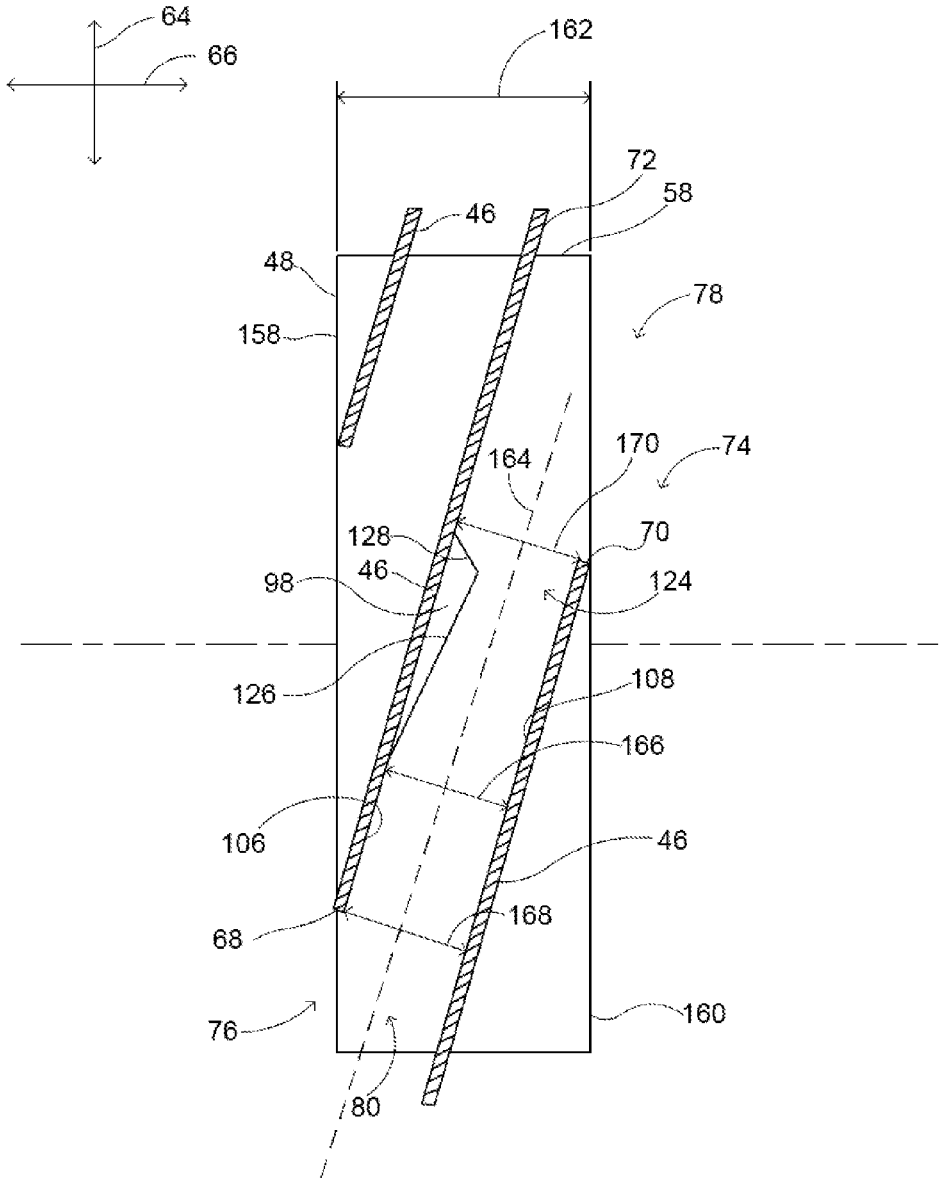
FIG. 7 is an enlarged top view of a portion of the supersonic compressor rotor shown in FIG. 6 along sectional line 7-7.

FIG. 6 is a perspective view of an alternative supersonic compressor rotor 40. FIG. 7 is an enlarged top view of a portion of supersonic compressor rotor 40 shown in FIG. 6 at sectional line 7-7. Identical components shown in FIG. 6 and FIG. 7 are labeled with the same reference numbers used in FIG. 4 and FIG. 5. In an alternative embodiment, rotor disk 48 includes an upstream surface 158, a downstream surface 160, and extends between upstream surface 158 and downstream surface 160 in axial direction 66. Each upstream surface 158 and downstream surface 160 extends between radially inner surface 56 and radially outer surface 58. Radially outer surface 58 extends circumferentially about rotor disk 48, and between upstream surface 158 and downstream surface 160. Radially outer surface 58 has a width 162 defined in axial direction 66. Each vane 46 is coupled to radially outer surface 58 and extends circumferentially about rotor disk 48 in a helical shape. Vane 46 extends outwardly from radially outer surface 58 in radial direction 64. In the exemplary embodiment, outer surface 58 has a substantially cylindrical shape. Alternatively, outer surface 58 may have a conical shape and/or any suitable shape to enable supersonic compressor rotor 40 to function as described herein.

Each vane 46 is spaced axially from an adjacent vane 46 such that flow channel 80 is oriented generally in axial direction 66 between inlet opening 76 and outlet opening 78. Flow channel 80 is defined between each pair 74 of axially-adjacent vanes 46. Each pair 74 of vanes 46 are oriented such that inlet opening 76 is defined at upstream surface 158 and outlet opening 78 is defined at downstream surface 160. An axial flow path 164 is defined in axial direction 66 along radially outer surface 58 from inlet opening 76 to outlet opening 78. In this alternative embodiment, flow channel 80 includes an axial width 166 that is defined between pressure side 106 and adjacent suction side 108 of vanes 46 and is substantially perpendicular to axial flow path 164. Inlet opening 76 has a first axial width 168 that is larger than a second axial width 170 of outlet opening 78. Alternatively, first axial width 168 of inlet opening 76 may be less than, or equal to, second axial width 170 of outlet opening 78.

In this alternative embodiment, at least one supersonic compression ramp 98 is coupled to each vane 46 and defines throat region 124 of flow channel 80 that is positioned between inlet opening 76 and outlet opening 78. Alternatively, supersonic compression ramp 98 is coupled to radially outer surface 58 of rotor disk 48. In the alternative embodiment, compression surface 126 of supersonic compression ramp 98 is position adjacent outlet edge 70 of vane 46 to define throat region 124 at outlet opening 78.

The above-described supersonic compressor rotor provides a cost effective and reliable method for increasing an efficiency in performance of supersonic compressor systems. Moreover, the supersonic compressor rotor facilitates increasing the operating efficiency of the supersonic compressor system by reducing the entropy rise within a fluid channeled through the supersonic compressor rotor. More specifically, the supersonic compression rotor includes a supersonic compression ramp configured to channel fluid through a flow path such that the fluid is characterized by a velocity that is supersonic at an outlet of the fluid channel. In addition, the supersonic compression ramp is further configured to prevent a formation of a normal shockwave within the flow channel that reduces the entropy rise of the fluid within the flow channel. As a result, the supersonic compressor rotor facilitates improving the operating efficiency of the supersonic compressor system. As such, the cost of maintaining the supersonic compressor system may be reduced.

Exemplary embodiments of systems and methods for assembling a supersonic compressor rotor are described above in detail. The system and methods are not limited to the specific embodiments described herein, but rather, components of systems and/or steps of the method may be utilized independently and separately from other components and/or steps described herein. For example, the systems and methods may also be used in combination with other rotary engine systems and methods, and are not limited to practice with only the supersonic compressor system as described herein. Rather, the exemplary embodiment can be implemented and utilized in connection with many other rotary system applications.

Although specific features of various embodiments of the invention may be shown in some drawings and not in others, this is for convenience only. Moreover, references to "one embodiment" in the above description are not intended to be interpreted as excluding the existence of additional embodiments that also incorporate the recited features. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A supersonic compressor rotor comprising:

a rotor disk comprising a body extending between a radially inner surface and a radially outer surface;

a plurality of vanes coupled to said body, said vanes extending outwardly from said rotor disk, adjacent said vanes forming a pair and oriented such that a flow channel is defined between each said pair of adjacent vanes, said flow channel extending between an inlet opening and an outlet opening; and at least one supersonic compression ramp positioned within said flow channel, said supersonic compression ramp configured to prevent a normal shockwave from being formed within said flow channel and to condition a fluid being channeled through said flow channel such that the fluid is characterized by a first velocity at said inlet opening and a second velocity at said outlet opening, each of said first velocity and said second velocity being supersonic with respect to said rotor disk surfaces, wherein said supersonic compression ramp comprises a compression surface extending between a leading edge and a trailing edge end said leading edge positioned closer to said inlet opening than said trailing edge, said trailing edge defining a throat region of said flow channel, said throat region having a minimum cross-sectional area of said flow channel, and wherein said trailing edge is positioned adjacent said outlet opening.

2. A supersonic compressor rotor in accordance with claim 1, wherein said supersonic compression ramp comprises a diverging surface coupled to said trailing edge, said diverging surface extending between a first end and a second end, said first end coupled to said compression surface and defining a first cross-section area of said flow channel, said second end positioned closer to said outlet opening than said first end and defining a second cross-sectional area that is greater than said first cross-sectional area.

3. A supersonic compressor rotor in accordance with claim 1, wherein each vane of said plurality of vanes comprises an outer surface that at least partially defines said flow channel, said at least one supersonic compression ramp coupled to said outer surface.

4. A supersonic compressor rotor in accordance with claim 1, wherein said rotor disk comprises an outer surface that at least partially defines said flow channel, said at least one supersonic compression ramp coupled to said outer surface.

5. A supersonic compressor rotor in accordance with claim 1, wherein said rotor disk includes an endwall extending substantially radially between said radially inner surface and said radially outer surface, said vanes coupled to said endwall, adjacent said vanes are spaced a circumferential distance apart such that said flow channel is defined between each said pair of circumferentially-adjacent vanes, said flow channel extending between said radially inner surface and said radially outer surface.

6. A supersonic compressor rotor in accordance with claim 1, wherein said rotor disk body comprises an upstream surface and a downstream surface, said radially outer surface extends generally axially between said upstream surface and said downstream surface, said vanes coupled to said radially outer surface, adjacent said vanes are spaced an axial distance apart such that said flow channel is defined between each said pair of axially-adjacent vanes, said flow channel extending between said upstream surface and said downstream surface.

7. A supersonic compressor system comprising:

a housing comprising an inner surface defining a cavity extending between a fluid inlet and a fluid outlet;

a drive shaft positioned within said housing, said drive shaft rotatably coupled to a driving assembly; and a supersonic compressor rotor coupled to said drive shaft, said supersonic compressor rotor positioned between said fluid inlet and said fluid outlet for channeling fluid from said fluid inlet to said fluid outlet, said supersonic compressor rotor comprising:

a rotor disk comprising a body extending between a radially inner surface and a radially outer surface;

a plurality of vanes coupled to said body, said vanes extending outwardly from said rotor disk, adjacent said vanes forming a pair and oriented such that a flow channel is defined between each said pair of adjacent vanes, said flow channel extending between an inlet opening and an outlet opening; and at least one supersonic compression ramp positioned within said flow channel, said supersonic compression ramp configured to prevent a normal shockwave from being formed within said flow channel and to condition a fluid being channeled through said flow channel such that the fluid is characterized by a first velocity at said inlet opening and a second velocity at said outlet opening, each of said first velocity and said second velocity being supersonic with respect to said rotor disk surfaces, wherein said supersonic compression ramp comprises a compression surface extending between a leading edge and a trailing e end, said leading edge positioned closer to said inlet opening than said trailing edge, said trailing edge defining a throat region of said flow channel, said throat region having a minimum cross-sectional area of said flow channel, and wherein said trailing edge is positioned adjacent said outlet opening.

8. A supersonic compressor system in accordance with claim 7, wherein said supersonic compression ramp comprises a diverging surface coupled to said trailing edge, said diverging surface extending between a first end and a second end, said first end coupled to said compression surface and defining a first cross-section area of said flow channel, said second end positioned closer to said outlet opening than said first end and defining a second cross-sectional area that is greater than said first cross-sectional area.

9. A supersonic compressor system in accordance with claim 7, wherein each vane of said plurality of vanes comprises a sidewall that at least partially defines said flow channel, said at least one supersonic compression ramp coupled to said sidewall.

10. A supersonic compressor system in accordance with claim 7, wherein said rotor disk comprises an outer surface that at least partially defines said flow channel, said at least one supersonic compression ramp coupled to said outer surface.

11. A method of assembling a supersonic compressor rotor, said method comprising:

providing a rotor disk that includes a body extending between a radially inner surface and a radially outer surface;

coupling a plurality of vanes to the body, adjacent vanes forming a pair and oriented such that a flow channel is defined between each pair of adjacent vanes, the flow channel extending between an inlet opening and an outlet opening; and coupling at least one supersonic compression ramp to one of a vane of the plurality of vanes and the rotor disk, the supersonic compression ramp positioned within the flow channel and configured to prevent a normal shockwave from being formed within said flow channel and to condition a fluid being channeled through the flow channel such that the fluid is characterized by a first velocity at the inlet opening and a second velocity at the outlet opening, each of the first velocity and the second velocity being supersonic with respect to the rotor disk surfaces, wherein said supersonic compression ramp comprises a compression surface extending between a leading edge and a trailing edge end said leading edge positioned closer to said inlet opening than said trailing edge, said trailing edge defining a throat region of said flow channel, said throat region having a minimum cross-sectional area of said flow channel, and wherein said trailing edge is positioned adjacent said outlet opening.

12. A method in accordance with claim 11, further comprising:

providing the rotor disk body including an endwall extending generally radially between the radially inner surface and the radially outer surface; and coupling the plurality of vanes to the endwall, adjacent vanes are spaced a circumferential distance apart such that the flow channel is defined between each pair of circumferentially-adjacent vanes, the flow channel extending between the radially inner surface and the radially outer surface.

13. A method in accordance with claim 11, further comprising:

providing the rotor disk body including an upstream surface and a downstream surface, the radially outer surface extending generally axially between the upstream surface and the downstream surface; and coupling the plurality of vanes to the radially outer surface, adjacent vanes are spaced an axial distance apart such that the flow channel is defined between each pair of axially-adjacent vanes, the flow channel extending between the upstream surface and the downstream surface.

* * * * *